US011312531B1

(12) United States Patent
Ezell

(10) Patent No.: US 11,312,531 B1
(45) Date of Patent: Apr. 26, 2022

(54) DUAL-ACTION CARTON SEPARATION SYSTEM AND METHOD OF USE

(71) Applicant: Rachman Ezell, Houston, TX (US)

(72) Inventor: Rachman Ezell, Houston, TX (US)

( * ) Notice: Subject to any disclaimer, the term of this patent is extended or adjusted under 35 U.S.C. 154(b) by 0 days.

(21) Appl. No.: 17/501,518

(22) Filed: Oct. 14, 2021

(51) Int. Cl.
*B65D 5/54* (2006.01)

(52) U.S. Cl.
CPC ..... *B65D 5/542* (2013.01)

(58) Field of Classification Search
CPC ..... B65D 5/54; B65D 5/5405; B65D 5/542; B65D 5/5425; B65D 5/0281; B65D 5/5445; B65D 5/16; B65D 5/543
See application file for complete search history.

(56) References Cited

U.S. PATENT DOCUMENTS 3,004,697 A * 10/1961 Stone ..... B65D 5/4266 428/43
3,469,766 A * 9/1969 Nelson ..... B65D 5/5445 229/235
4,000,811 A * 1/1977 Hardison ..... B65D 5/48048 229/242
4,174,041 A * 11/1979 Turner ..... B65D 5/0005 229/103.3
4,805,765 A * 2/1989 Barrett ..... B65D 5/724 206/738
5,265,799 A * 11/1993 Stone ..... B65D 5/543 229/122.33
5,358,176 A * 10/1994 Rigby ..... B65D 5/5455 229/227
5,484,102 A * 1/1996 DeMay ..... B65D 5/5415 229/132
5,622,309 A * 4/1997 Matsuda ..... B65D 5/5425 229/243
6,063,415 A * 5/2000 Walters ..... B65D 5/029 206/738
6,209,785 B1 * 4/2001 Ben-Haim ..... B65D 5/541 206/542
6,422,454 B1 * 7/2002 Barr ..... B65D 5/4204 229/110
8,342,389 B2 * 1/2013 Mills ..... B65D 75/66 229/87.05
8,998,074 B2 * 4/2015 Schomisch ..... B65D 5/541 229/242
9,061,791 B2 * 6/2015 Cameron ..... B65D 5/443
9,327,866 B2 * 5/2016 Strom ..... B65D 83/08
9,950,829 B2 * 4/2018 Miller ..... B65D 5/326
10,336,481 B2 * 7/2019 Jolley ..... B65B 7/20
10,787,289 B1 * 9/2020 Bellamah ..... B31B 50/25
2003/0226783 A1 * 12/2003 Jackson ..... B65D 5/16 206/772
2004/0149746 A1 * 8/2004 Hoese ..... B65D 81/3453 219/730
2005/0061865 A1 * 3/2005 Marie ..... B65D 5/5445 229/237

(Continued)

*Primary Examiner* — Dariush Seif
(74) *Attorney, Agent, or Firm* — Leavitt Eldredge Law Firm

(57) ABSTRACT

A dual-action carton separation system helps keep a carton secure while in storage or transit. When it is to be opened a lock tab is removed that then allows a top panel to be pulled back along perforations. The lock tab could have a release tab attached to it that allows for it to be better pulled or otherwise removed from the carton.

3 Claims, 4 Drawing Sheets

(56) References Cited

U.S. PATENT DOCUMENTS

2005/0189406 A1* 9/2005 Welchel ..... B65D 75/527 229/235
2005/0263434 A1* 12/2005 Tibbels ..... B65D 5/0227 206/767
2007/0257096 A1* 11/2007 Coltri-Johnson .... B65D 5/4295 229/242
2007/0295796 A1* 12/2007 Sutherland ..... B65D 5/5253 229/240
2008/0237070 A1* 10/2008 Justice ..... B65D 5/324 206/215
2010/0270367 A1* 10/2010 Brandenburger ..... B65D 5/542 229/117.13
2010/0276333 A1* 11/2010 Couture ..... B65D 5/5445 206/774
2011/0057022 A1* 3/2011 Sinclair ..... B65D 5/542 229/124
2012/0006818 A1* 1/2012 Fester ..... B65D 65/403 220/62.2
2013/0186804 A1* 7/2013 Miller ..... B65D 5/4204 206/772
2013/0306718 A1* 11/2013 Sumpmann ..... B65D 5/5445 229/200
2014/0054289 A1* 2/2014 Bogdziewicz, III ..... B65D 5/72 220/266
2014/0166507 A1* 6/2014 Philips ..... B65D 5/5445 206/45.29
2014/0209504 A1* 7/2014 Strom ..... B65D 83/08 206/774
2016/0304234 A1* 10/2016 Herkenrath ..... B65D 33/12
2016/0304235 A1* 10/2016 Herkenrath ..... B65D 5/321
2016/0318655 A1* 11/2016 Lu ..... B65D 5/5445
2017/0121052 A1* 5/2017 Morimoto ..... B65D 5/0236
2017/0349322 A1* 12/2017 Mulvey ..... B65D 5/4266
2018/0170610 A1* 6/2018 Buss ..... B65D 5/6661
2018/0215499 A1* 8/2018 Imai ..... B65D 5/541
2019/0023450 A1* 1/2019 Dhadda ..... B65D 5/542
2019/0127112 A1* 5/2019 Gray ..... B31B 50/14
2019/0135482 A1* 5/2019 Pratsch ..... B65D 5/4608
2019/0344925 A1* 11/2019 Block ..... B65D 5/52
2020/0017254 A1* 1/2020 Zeiler ..... B65D 5/106
2020/0189790 A1* 6/2020 Bourne ..... B65D 5/029
2020/0216247 A1* 7/2020 Barran ..... B65D 75/5838

* cited by examiner

DUAL-ACTION CARTON SEPARATION SYSTEM AND METHOD OF USE

BACKGROUND

1. Field of the Invention

The present invention relates generally to carton systems and methods, and more specifically, to a dual-action carton separation system that ensures that a box or another type of container remains closed until it is to be opened and then to open easily.

2. Description of Related Art

Carton systems are well known in the art and are effective means to store and transport goods or items therein. Common carton systems include boxes of cardboard or other products that are pliable and otherwise able to fold and bend. Commonly, cartons are made of side walls and folding flaps that are taped shut to enclose a space within. Other cartons include a rigid box with a rigid lid that when placed on the box is taped or adhesively closed.

One of the problems associated with common carton systems is their limited efficiency. For example, when the carton is opened, a knife or blade is used to cut the tape, flaps, or lid so that the space within the carton and its contents is accessible. When the tape or carton is cut damage could occur to the contents and when the carton itself is cut cannot be reused.

Additionally, weakened sections or pull away sections come loose in transport or when they are bumped or similarly damaged. This accidental release exposes the contents of the cart and could result in loss or damage.

Accordingly, although great strides have been made in the area of carton systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
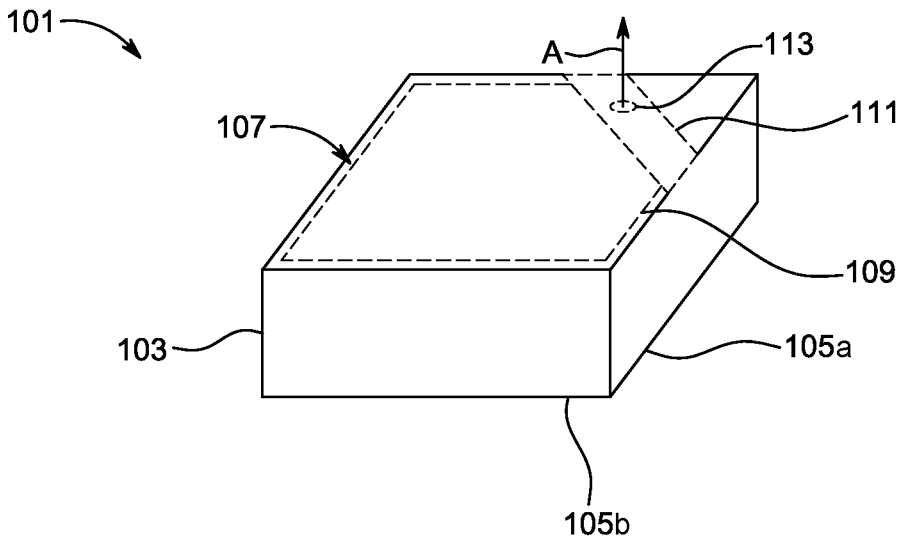
FIGS. 1A, 1B, and 1C are perspective views of dual-action carton separation system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional carton systems. Specifically, the present invention provides for the quick and deliberate release of the carton to access the space or items within it. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
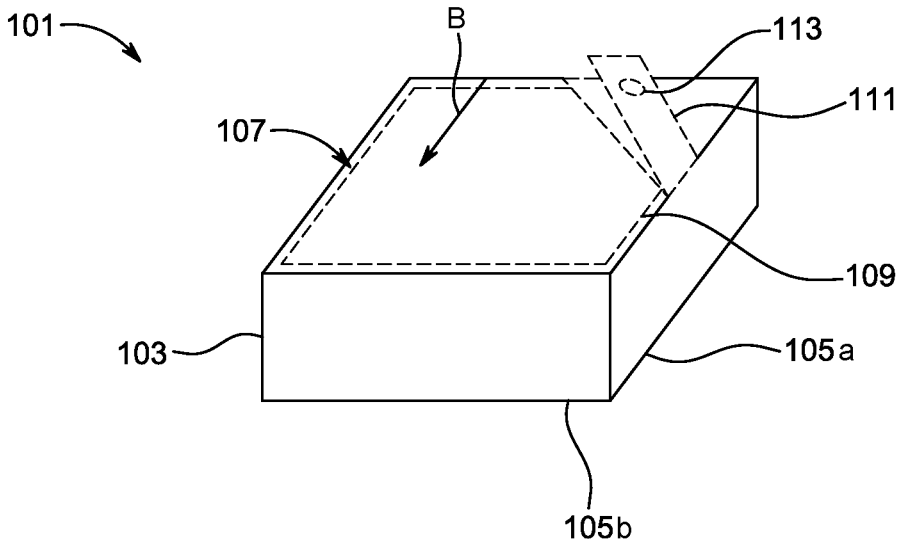
Figure 1C:
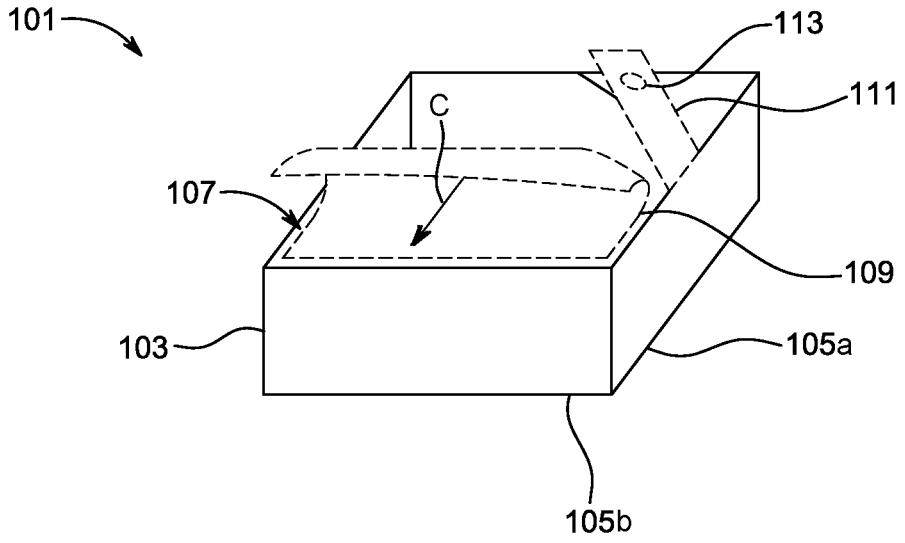

Referring now to the drawings wherein like reference characters identify corresponding or similar elements throughout the several views, FIGS. 1A, 1B, and 1C depict perspective views of a dual-action carton separation system in accordance with a preferred embodiment of the present application. It will be appreciated that system 101 overcomes one or more of the above-listed problems commonly associated with conventional carton systems.

In the contemplated embodiment, system 101 includes a carton 103 made of walls 105. The top panel 109 is releasably attached to the walls 105 on the top surface 107 via perforations or lines of weakness. The top panel 109 is also attached to the walls 105 by a lock tab 111. The lock tab 111 also has a release tab 113 attached thereto.

In use, the carton 103 is held closed by the walls 105 and the top panel 109 that are adhesively closed. The release tab 113 is pulled as depicted by motion A and allows for the lock tab 111 to be pulled up and away from the carton 103 as depicted by motion B. With the lock tab 111 removed the top panel 109 is pulled up and away from the walls 105 as depicted by motion C to open the space enclosed by the walls 105.

It should be appreciated that one of the unique features believed characteristic of the present application is that the lock tab 111 keeps the top panel 109 attached to the walls 105 to secure the space within the walls 105 or items stored therein until it is opened via the lock tab 111.

It is contemplated that while the lock tab 111 has been depicted on the top surface 107 that it could be attached to and part of any other surface of the carton 103. For example, the lock tab could be attached to the side surface so that when pulled the top panel or another panel is released and able to move.

Figure 2:
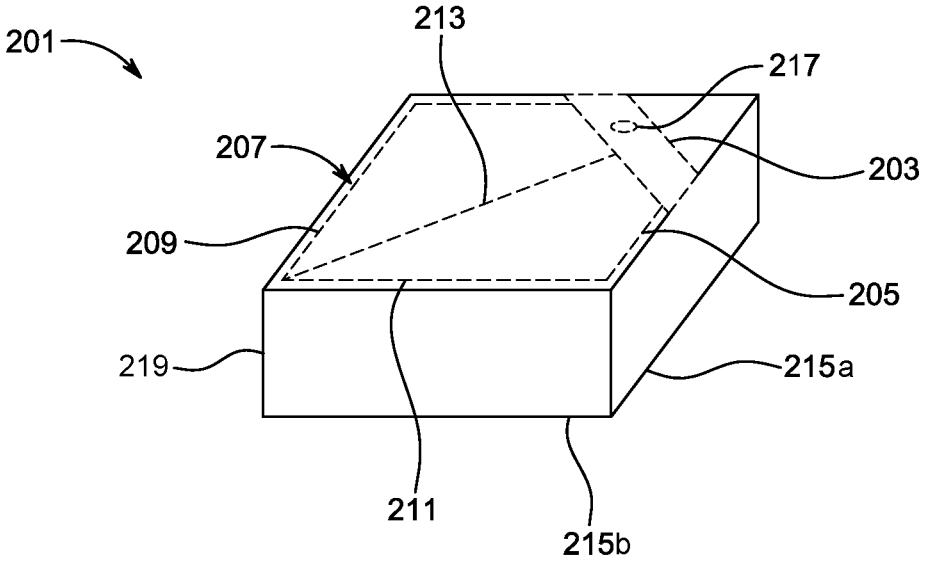
FIG. 2 is a perspective view of an alternative embodiment of the system of FIGS. 1A, 1B, and 1C.

Referring now to FIG. 2 an alternative embodiment of system 101 is depicted. Embodiment 201 includes a carton 219 that is made of walls 215 with a top panel 205 on the top surface 207 thereof. The top panel 205 is attached to the walls via perforations or lines of weakness. The top panel 205 is secured by a lock tab 203 with a release tab 217. The top panel 205 is divided into a first panel 209 and a second panel 211 by a center line 213. When the top panel 205 is removed after the lock tab 203 is removed, the first panel 209 separates along the center line that is formed of perforations or lines of weakness from the second panel 211. It is contemplated that the top panel 205 divided in this way allows for greater control over access to the space within the carton 219.

Figure 3:
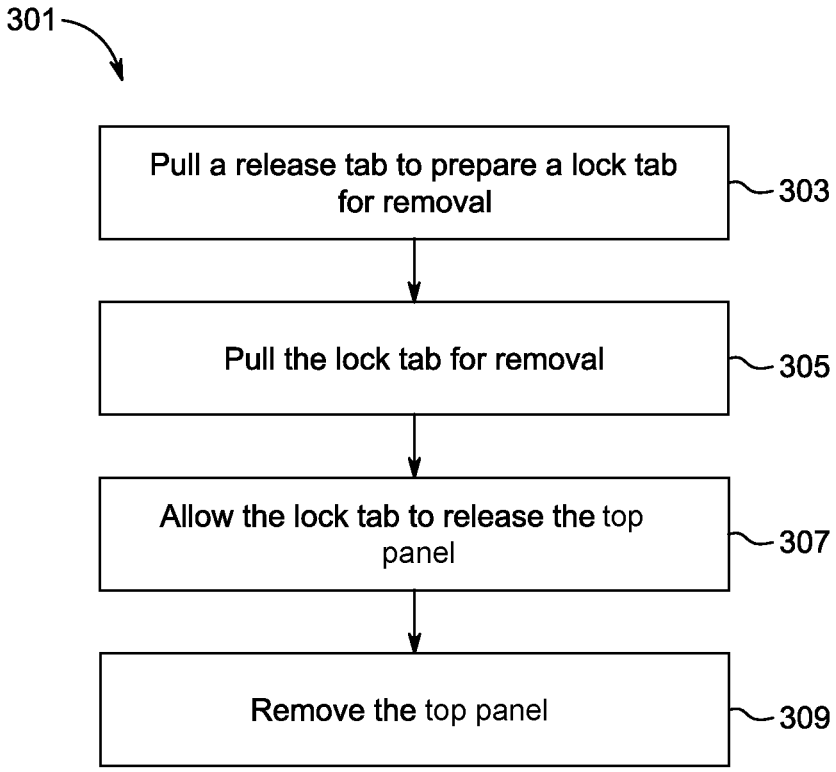
FIG. 3 is a flowchart of a method of opening a carton.

Referring now to FIG. 3 a method of opening a carton is depicted. Method 301 includes pulling a release tab to prepare a lock tab for removal 303, pulling the lock tab for removal 305, allowing the lock tab to release the top panel 307, and removing the top panel 309.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A dual-action carton separation system comprising:

a carton created by a plurality of walls;

at least one top panel attached to at least one of the walls on the top surface thereof via lines of weakness, the at least one top panel having a first panel and a second panel, the first panel is separated from the second panel via a center line;

at least one lock tab attached to the at least one top panel and at least one of the walls via lines of weakness, the at least one lock tab is oriented perpendicular to the longitudinal length of the center line; and a release tab secured to the lock tab;

wherein the at least one lock tab prevents the at least one top panel from detaching from the top surface until the at least one lock tab is first removed.

2. The system of claim 1 wherein the lock tab is attached to the at least one top panels via lines of weakness but is attached to a side surfaces of the at least one carton.

3. A dual-action carton separation system comprising:

a carton that is closed by at least one top panel that cannot be removed until a lock tab is first removed.

* * * * *